US011814844B2

(12) United States Patent
Johansson

(10) Patent No.: US 11,814,844 B2
(45) Date of Patent: Nov. 14, 2023

(54) BUILDING STUD, WALL STRUCTURE COMPRISING SUCH A BUILDING STUD AND A METHOD FOR FORMING A WALL STRUCTURE

(71) Applicant: Atricon AB, Karlstad (SE)

(72) Inventor: Patrick Johansson, Molkom (SE)

(73) Assignee: Atricon AB, Kista (SE)

( * ) Notice: Subject to any disclaimer, the term of this patent is extended or adjusted under 35 U.S.C. 154(b) by 39 days.

(21) Appl. No.: 17/424,507

(22) PCT Filed: Feb. 17, 2020

(86) PCT No.: PCT/SE2020/050174

§ 371 (c)(1),
(2) Date: Jul. 21, 2021

(87) PCT Pub. No.: WO2020/171756

PCT Pub. Date: Aug. 27, 2020

(65) Prior Publication Data

US 2022/0145631 A1 May 12, 2022

(30) Foreign Application Priority Data

Feb. 18, 2019 (SE) ..... 1930064-9
Mar. 26, 2019 (SE) ..... 1930096-1

(51) Int. Cl.
*E04C 3/292* (2006.01)
*E04B 2/58* (2006.01)
(Continued)

(52) U.S. Cl.
CPC ..... *E04C 3/292* (2013.01); *E04B 2/58* (2013.01); *E04B 2/70* (2013.01); *E04B 2/7412* (2013.01);
(Continued)

(58) Field of Classification Search
CPC ..... E04B 1/30; E04B 2/58; E04B 2/70; E04B 2/7412; E04B 2/7863; E04B 2/7872;
(Continued)

(56) References Cited

U.S. PATENT DOCUMENTS 96,793 A * 11/1869 Gatling ..... E04C 3/292 52/376
139,904 A * 6/1873 Lummus ..... E04C 3/292 52/376
(Continued)

FOREIGN PATENT DOCUMENTS

CA 2462467 A 9/2004
CN 2723580 Y 9/2005
(Continued)

OTHER PUBLICATIONS

PRV Search Report dated Sep. 16, 2019 in application SE 1930064-9.
(Continued)

*Primary Examiner* — Jessie T Fonseca
(74) *Attorney, Agent, or Firm* — Knobbe, Martens, Olson & Bear, LLP

(57) ABSTRACT

Building stud (10) for forming a framework for mounting wall panels, comprising a first (12) and a second (14) flange portion and a web portion (16) interconnecting the flange portions. The flange portions comprise a planar, elongated wood fibre member (18, 20), and the web portion comprises a sheet metal member (22) including a first (24) and a second (26) rectilinear line of weakness, which lines of weakness are parallel and along which the sheet metal member is foldable to enable folding the building stud from a retracted storage position to an expanded mounting position.

11 Claims, 6 Drawing Sheets

(51) Int. Cl.

| | |
|---|---|
| ***E04B 2/70*** | (2006.01) |
| ***E04C 3/29*** | (2006.01) |
| ***E04B 2/74*** | (2006.01) |
| ***E04C 3/00*** | (2006.01) |
| ***E04B 2/78*** | (2006.01) |
| *E04B 1/30* | (2006.01) |

(52) U.S. Cl.
CPC ..... *E04B 2/789* (2013.01); *E04B 2/7863* (2013.01); *E04B 2/7872* (2013.01); *E04B 2/7881* (2013.01); *E04C 3/005* (2013.01); *E04C 3/291* (2013.01); *E04B 1/30* (2013.01)

(58) Field of Classification Search
CPC ..... E04B 2/7881; E04B 2/789; E04C 3/005; E04C 3/291; E04C 3/292
See application file for complete search history.

(56) References Cited

U.S. PATENT DOCUMENTS

| | | | | | |
|---|---|---|---|---|---|
| 385,624 | A * | 7/1888 | Hodges | E04C 3/292 | 14/4 |
| 1,475,409 | A * | 11/1923 | Riddle | E04C 3/29 | 52/241 |
| 2,154,944 | A * | 4/1939 | Kullmer | E04C 3/292 | 52/694 |
| 2,167,835 | A * | 8/1939 | Greulich | E04C 3/292 | 52/376 |
| 2,387,432 | A * | 10/1945 | Du Laney | E04C 3/29 | D25/58 |
| RE29,412 | E * | 9/1977 | Zinn | E04B 2/7457 | 52/846 |
| 4,333,293 | A * | 6/1982 | Jackson | E04C 3/292 | 52/693 |
| 4,862,667 | A | 9/1989 | Melland | | |
| 5,079,894 | A * | 1/1992 | Lau | E04C 3/14 | 52/847 |
| 6,254,306 | B1 | 7/2001 | Williams | | |
| 8,215,597 | B1 * | 7/2012 | Medlin, Sr. | H05K 5/0204 | 248/200.1 |
| 2002/0053180 | A1 * | 5/2002 | McGrath | E04B 2/7411 | 52/481.1 |
| 2002/0157329 | A1 * | 10/2002 | Berdan, II | E04B 2/7411 | 52/144 |
| 2003/0115827 | A1 * | 6/2003 | Sim | E04C 3/292 | 52/837 |
| 2004/0093822 | A1 | 5/2004 | Anderson | | |

FOREIGN PATENT DOCUMENTS

| | | | | |
|---|---|---|---|---|
| CN | 104755679 | A | | 7/2015 |
| CN | 205063104 | U | | 3/2016 |
| CN | 205935398 | U | | 2/2017 |
| CN | 207032616 | U | | 2/2018 |
| CN | 111350307 | A | * | 6/2020 |
| CN | 114575498 | A | * | 6/2022 |
| EP | 1837451 | A2 | | 9/2007 |
| FR | 2874951 | A1 | * | 3/2006 |
| FR | 2874951 | A1 | | 3/2006 |
| GB | 2436335 | A | * | 9/2007 |
| SE | 9201471 | | | 5/1992 |
| WO | WO-0079070 | A1 | * | 12/2000 |
| WO | WO 03/078751 | A1 | | 9/2003 |
| WO | WO-2007065182 | A1 | * | 6/2007 |

OTHER PUBLICATIONS

ISR dated Mar. 13, 2020.
Search Report of PRV dated Sep. 16, 2019 in application SE1930096-1.
Supplementary European Search Report in EP Application No. 20758621.5 dated Oct. 11, 2022.
Search Report issued in the corresponding Chinese Patent Application No. 202080015051.5 dated Jul. 22, 2022 in 3 pages.
First Office Action in in the corresponding Chinese Patent Application No. 202080015051.5 dated Jul. 29, 2022 in 7 pages including English translation.

* cited by examiner

BUILDING STUD, WALL STRUCTURE COMPRISING SUCH A BUILDING STUD AND A METHOD FOR FORMING A WALL STRUCTURE

The present invention relates to a building stud for forming a framework for mounting wall panels, a wall structure comprising such a building stud and a method for forming a wall structure.

When building walls, a framework with studs is built. Horizontally, a top plate is mounted on the ceiling and on the floor a bottom plate. Vertical studs are then placed between these, usually with a mutual spacing of 450-600 mm. When the framework is mounted, wall panels are nailed or screwed to the framework. Thus, the distance between the studs is determined by the width of the wall panels to be fixed to the studs. Common materials in wall panels are gypsum, MDF (Medium Density Fibre), OSB (Orientated Strand Board), shavings and wood chips. Magnesium oxide, calcium silicate, fibre cement and fibre gypsum boards as well as various types of composite boards also exist.

When constructing walls in general and interior walls in particular studs, made from steel or wood are manly used today. Wooden studs are usually homogeneous and square and work great for screwing or nailing wall panels. However, wooden studs are relatively heavy and tend to propeller during storage.

Steel studs are usually used in wall structures that are built using so-called lightweight framing construction technique. Typically, such a wall structure comprises a framework of metal profile studs forming a support or frame which is then covered with sheet-shaped building boards. The framework includes horizontal studs that form top plates and bottom plates, which studs usually have a U-shaped cross section. Standing studs are mounted in the top and bottom plates with a predetermined mutual distance, on which plates and studs the building boards are then mounted.

Steel studs are usually made from steel sheets which are cut and bent to obtain a desired profile. Typically, a steel stud comprises two parallel flange members which are joined by a transverse web member extending substantially perpendicular to the flange members. The steel stud can thus obtain a substantially C-shaped cross-section. Steel studs are often made from steel sheets having a relatively small thickness. For example, it is common for steel studs to be made of steel sheets having a thickness within the range of 0.4-0.6 mm. The thin material thickness is important from a cost perspective, but also has great significance for the sound transmission in the wall. Thin steel provides better reduction of sound propagating through the wall, as a thin web portion provides less sound transmission between the flange portions than a thick web portion. Another advantage related to steel studs is that they can be "boxed" during transport and storage, i.e. placed in each other. In this way, the volume that the steel studs take up can be reduced, which is important from a storage perspective and considering costly and environmentally harmful transports. It is also of great importance in workplaces, where there is often a lack of storage space.

When mounting wall panels in a framework, a common mounting distance between nails or screws is, at the edge portions of the wall panels, about 200 mm cc distance and, in the middle of the panels, about 300 mm cc distance. The predominant mounting method for wood framing is screwing, although this is more time-consuming and entails greater load on the installer than nailing. One reason for this is that when nailing in wooden rails, there is a risk that the nails are "worked out" by the shape change that occurs in wood when the humidity in the air changes. Nails that creep out in this way can then result in visible defects on the surfaces of the finished walls and can also be seen through paint or wallpaper.

In a framework consisting of steel studs, nailing is not possible as the steel is too thin for nails to attach in an intended way. When thin-plated studs are used, it can also be problematic to attach hard wall panels to the framework by screwing. In the case of hard plasterboard, plywood and OSB, for example, the resistance that arises when the screw's skull is to be mechanically recessed in the wall panel may become so large that the interaction between the screw and the steel stud deforms the steel stud rather than pushing the screw into the stud. The screw thread then loses its traction in the steel stud.

It is an object of the present invention to provide a new type of building stud, as well as a related method, which can help to at least partially solve this problem.

One aspect of the invention relates to a building stud for forming a framework for mounting wall panels, which building stud comprises a first and a second flange portion and a web portion interconnecting the flange portions. Each flange portion comprises a planar, elongated wood fibre member which may have a substantially rectangular cross section, and the web portion comprises a sheet metal member including a first and a second rectilinear line of weakness, which lines of weakness are parallel and along which the sheet metal member is foldable to enable the building stud to be brought from a retracted storage position to an expanded mounting position.

For example, respective wood fibre member may be a panel or board of homogeneous wood or of chipboard or wood fibre laminate. The sheet metal member may be a steel sheet having a thickness within the range of 0.3-1.5 mm. In other words, the stud according to the invention is a hybrid of wood fibre and metal.

The sheet metal member may comprise a first attachment portion which is adjoined and attached to the first flange portion, a second attachment portion which is adjoined and attached to the second flange portion, and a web portion disposed between the attachment portions, said first line of weakness forming a boundary between said first attachment portion and said web portion, and which second line of weakness forms a boundary between the second attachment portion and the web portion. The joint between the attachment portions and the respective web portion may be a nail joint, a screw joint, a glue joint or a combination thereof. Alternatively, or as a complement, a groove may be milled in the respective flange portion, in which groove a free edge of the attachment portion may be attached.

The interaction between the attachment portions and the flange portions helps to reduce shape-changes of the wood fibre members in the flange portions, e.g. caused by variations in humidity. In other words, the attachment portions help eliminate or at least reduce problems that may occur when the wood fibre members settle.

In the storage position, the flange portions may be arranged in a common plane and in the mounting position the flange portions may be arranged in two parallel planes.

In the storage position, the sheet metal member may have a rectangular shape and in the mounting position a U-shaped cross section.

The lines of weakness may be formed by embossing, i.e. by deforming the sheet metal element continuously or discontinuously along the lines of weakness. Alternatively, or as a complement, the lines of weakness may be formed by machining recesses along the lines of weakness. The lines of weakness may also, alternatively or as a supplement, be formed by partially through-cutting the sheet metal member's goods continuously or discontinuously along the lines of weakness.

Each wood fibre member may have a substantially rectangular cross section and its cross-sectional dimensions may be customized to achieve desired performance. For example, when installing plywood and gypsum wall panels, the respective cross-sectional dimensions of the wood fibre members may be 40 mm wide and 15 mm thick. This width provides ample space for joining two panel edges on the same stud, while at the same time providing good conditions for securely screwing or nailing the wall panels. In addition, this construction solves the problem of movements in the wood material due to moisture and the influence on the position of the nail this normally brings in homogeneous wooden stud, since no wood is at the tip of the nail. The movement of the wood material cannot force the nail out of its attachment, but only produce varied "clamping" of its body. Of course, this assumes that the nails have a length that exceeds the total thickness of the mounted wall panel and the wood fibre member.

The web portion may comprise one or more of said sheet metal members. This or these sheet metal members may be elongated.

With the building stud according to the invention good sound reduction is obtained because the web member of the web portion connecting the flange portions can be formed using thin steel. Homogeneous wooden studs have very poor noise reduction as they are compact and provide a good transmission path for the sound. In addition, the material in the web member can be designed with the technical solutions that already today improve sound reduction in known steel studs. Examples of this are various forms of grooves or recesses that are often combined with slitted lines to make the steel more flexible, which effects sound reduction performance.

Another aspect of the invention relates to a wall structure comprising a building stud as described above.

Yet another aspect of the invention relates to a method of forming a wall structure comprising a plurality of elongated building studs, each comprising a first and a second flange portion and a web portion interconnecting the flange portions, each flange portion comprising a flat elongated wood fibre member, and wherein the flange portion comprises a first and a second rectilinear line of weakness, which lines of weakness are parallel. The method comprises the steps of:

- bringing each building stud, by folding the sheet metal member along said lines of weakness, from a retracted storage position in which the flange portions are arranged in a common plane, to an expanded mounting position in which the flange portions are arranged in two parallel planes;
- when the building studs having been brought from the storage position to the mounting position, positioning and fixing the building studs in a framework with their respective first flange portion arranged in a common plane; and
- attaching one or a plurality wall panels directly or indirectly to the first flange portions.

The problem with the space-demanding form is solved by the stud permitting storage and transport in the retracted storage position. In the storage position, the flange portions can be arranged in a common plane and the web portion, which in the storage position can be planar, can be arranged lying on the flange portions.

Any length adjustment of the building stud prior to mounting can advantageously be carried out when the building stud is in the storage position.

The studs can thus easily be expanded by the installer at the time of installation. The shape of the studs in the expanded position is determined by where the sheet metal member is attached to the wood fibre members and where the lines of weakness are positioned. The stud's profile in the expanded position can be H-shaped, U-shaped or Z-shaped, as desired and depending area of use.

Said sheet metal member may be elongated.

The web portion may comprise only one sheet metal member extending along the stud.

The web portion may comprise a plurality of sheet metal members arranged so that the first lines of weakness are aligned along a common first rectilinear line and the second lines of weakness are aligned along a common second rectilinear line, which second rectilinear line is parallel to the first rectilinear line.

In the following, embodiments of the invention will be described in more detail with reference to the accompanying figures, in which.

Figure 1:
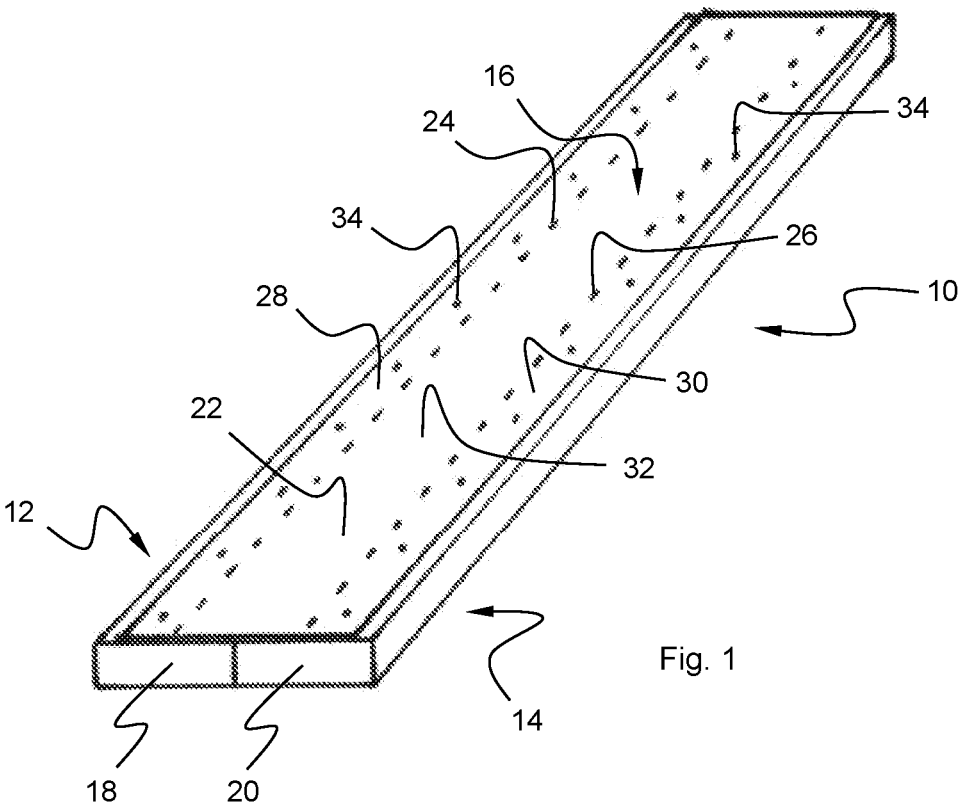
FIG. 1 shows an embodiment of a building stud according to the invention in a storage position.

FIG. 1 shows an embodiment of a building stud 10 according to the invention. The stud 10 comprises a first flange portion 12, a second flange portion 14 and a web portion 16 interconnecting the flange portions 12, 14. Each flange portion 12, 14 comprises a planar, elongated wood fibre member 18, which in the illustrated embodiment has a rectangular cross-section with a cross-sectional dimension of 15 mm by 40 mm. In the illustrated embodiment, the respective flange portions 12, 14 are formed of uniform boards of homogeneous wood, but the flange portions 12, 14 may be non-uniform and include or be made of other types of wood fibre members, for example, wood fibre members made of chipboard or wood fibre laminate.

The web portion 16 comprises an elongated sheet metal member 22 having a rectangular shape and a length corresponding to the length of wood fibre member 18, 20. In the illustrated embodiment, the width of the sheet metal member 22 is slightly less than the combined width of the wood fibre members 16, 18. In the embodiment shown, the sheet metal member 22 is formed from a steel sheet having a thickness of 0.5 mm.

The sheet metal member 22 has a first line of weakness 24 and a second line of weakness 26 which are rectilinear and parallel and along which sheet metal member 22 is foldable. The sheet metal member 22 is plastically deformable along the lines of weakness 24, 26 to enable folding of the sheet metal member 22 along the same. In the illustrated embodiment, the lines of weakness 24, 26 are made up by discontinuous crease lines formed in the sheet metal member 22 along the lines of weakness 24, 26. However, the lines of weakness 24, 26 may be formed in other ways, for example by through-going recesses or slits cut along the lines of weakness 24, 26. Also, alternatively or as a complement, the lines of weakness 24, 26 may be formed by partially cutting the material of the sheet metal member 22 along the lines of weakness, either continuously or discontinuously along the lines of weakness 24, 26.

The sheet metal member 22 comprises a first attachment portion 28 which abuts and is attached to the first flange portion 12, a second attachment portion 30 which abuts and is attached to the second flange portion 14, and a web member 32 which is disposed between the attachment portions 28, 30. The first line of weakness 24 forms a boundary between the first attachment portion 28 and the web member 32, and the second line of weakness 26 forms a boundary between the second attachment portion 30 and the web member 32.

In the illustrated embodiment, the attachment portions 28, 30 are connected to their respective flange portions 12, 14 by nails 34 forming a nail joint. The connection between the attachment portions 28, 30 and the flange portions 12, 14 may alternatively be a screw joint, a glue joint or a combination of a nail, screw or adhesive joint. Alternatively, or as a complement, a groove (not shown) can be milled in the respective flange portion, into which groove the free edge of the attachment portion can be attached. However, in such an embodiment, the free edge must be bent 90 degrees to be inserted into the groove.

FIG. 1 shows the building stud 10 in a storage position. In this position, the flange portions 12, 14 are arranged side by side in a common plane and the web portion 16, which in this position is planar, is arranged parallel to and on top of the flange portions 12, 14. This makes it easy to transport and store the building stud 10, since several studs can be stacked one on top of the other in a space-efficient manner.

Figure 2:
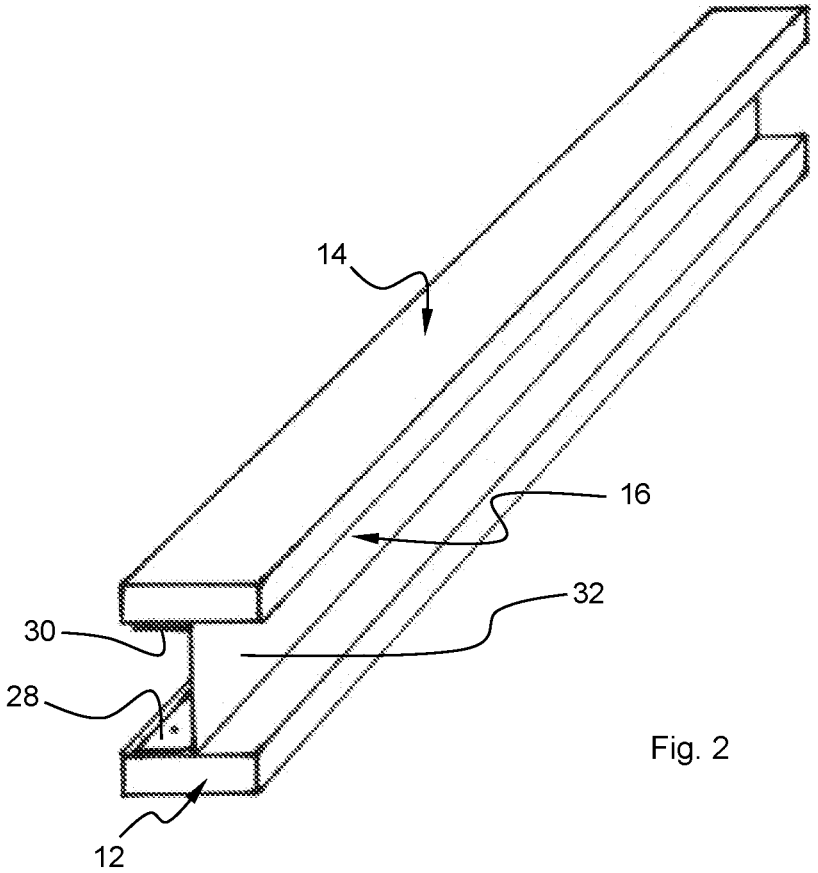
FIG. 2 shows the building stud of FIG. 1 in a mounting position.

When an installer is to mount the building stud 10 in a wall structure, he brings the building stud 10 from the retracted storage position shown in FIG. 1 to an expanded mounting position shown in FIG. 2. This is done by the installer manually rotating the flange portions 12, 14 in relation to each other around the lines of weakness 24, 26 so that the flange portions 12, 14 become arranged in two parallel planes. In this movement, the sheet metal member 22 is plastically deformed locally along the lines of weakness and allows the attachment portions 28, 30 to form a right angle to the web member 32, as shown in FIG. 2. However, the web member 32 and the attachment portions 28, 30 retain their respective planar shapes and, thus, the flange portion 16 obtain a U-shaped cross section.

Figure 3:
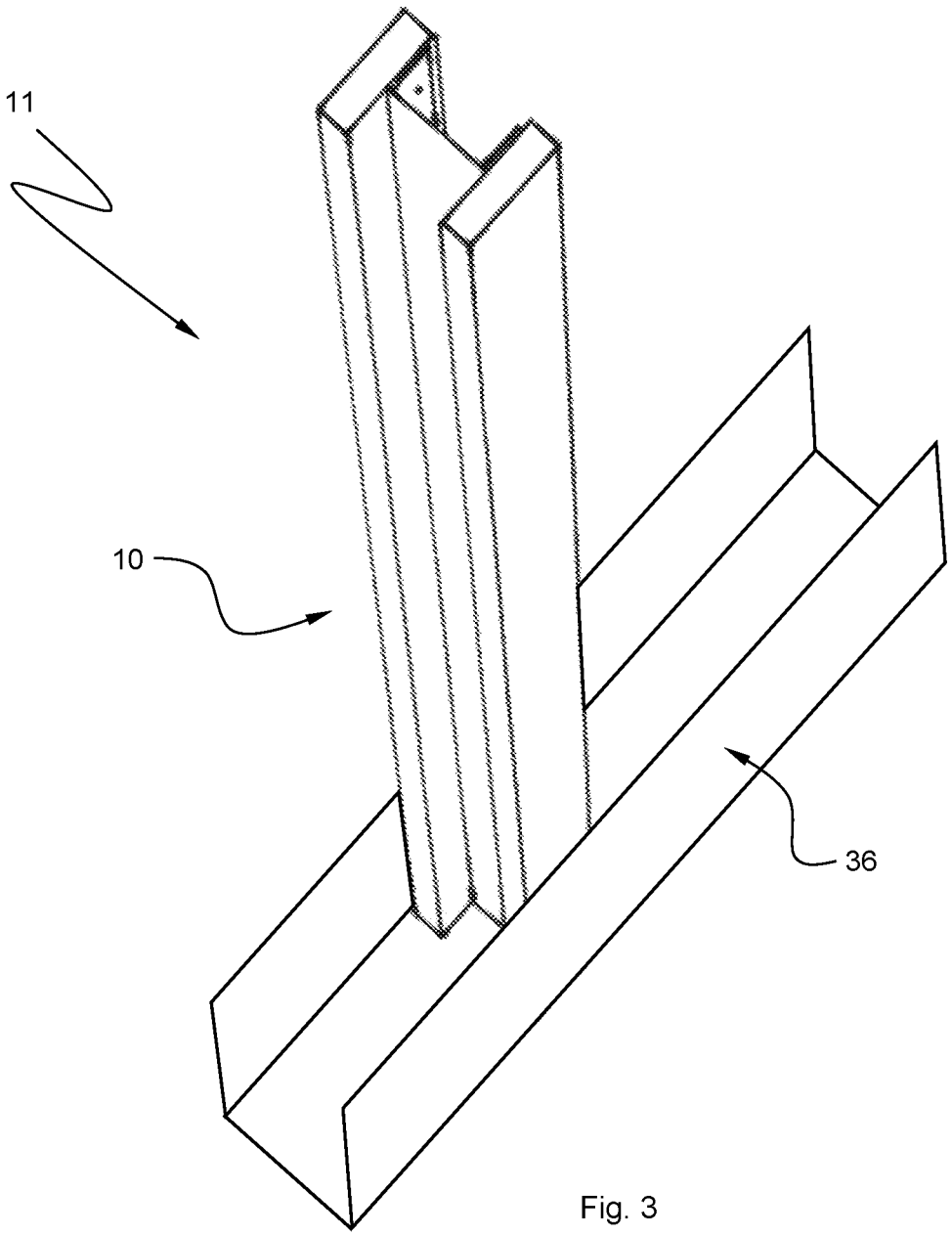
FIG. 3 shows the building stud of FIG. 2 mounted in a profiled plate.

When the building stud 10 has been brought to the mounting position, the installer can arrange the building stud in a wall structure 11, as illustrated in FIG. 3, where the building stud 10 has been placed in a rail-shaped sill 36 for further attachment. Any length adjustment of the building stud 10 prior to mounting can advantageously be carried out when the building stud is in the storage position.

Figure 4:
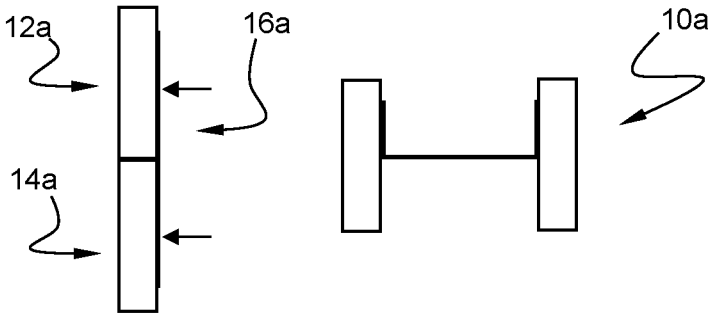
FIGS. 4-6 show various configurations of building studs according to the invention.
Figure 5:
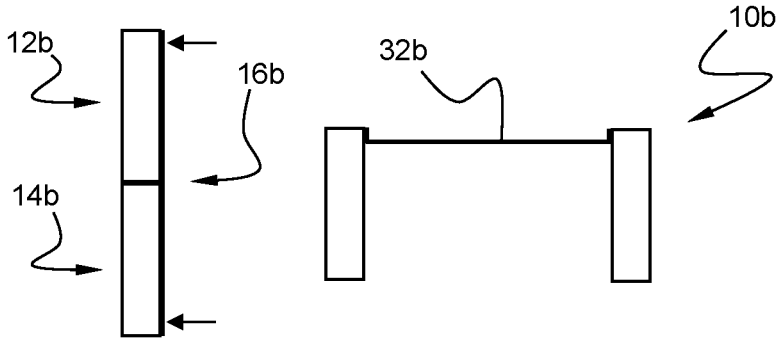
Figure 6:
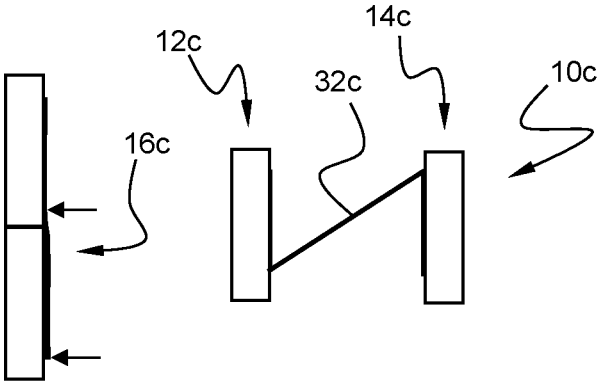

FIGS. 4-6 show schematically alternative embodiments of the attachment of the web portion to the flange portions and alternative locations of the lines of weakness. The figures show the studs in cross-section and the positions of the lines of weakness are indicated by arrows. In the respective figure, the stud is shown in the storage position on the left and in the mounting position on the right.

In the embodiment shown in FIG. 4, the web portion 16*a* is fixed to the flange portions 12*a*, 14*a* in the same way as in the embodiment shown in FIGS. 1.3, i.e. the lines of weakness are located at the central portions of the flange portions 12*a*, 14*a*. Thus, in the mounting position the stud 10*a* obtains a substantially I- or H-shaped profile.

In the embodiment shown in FIG. 5, the lines of weakness are offset closer to the edges of the flange portions 12*b*, 14*b* and as a result the stud 10*b* obtains, in the mounting position, a substantially U-shaped profile but with an asymmetrically positioned web member 32*b*.

In FIG. 6, the web portion 16*c* is, in the storage position, folded double over the second flange portion 14*c* and the lines of weakness are positioned so that the web member 32*c*, in the mounting position, extends diagonally between the web members 12*c*, 14*c*. This causes the stud 10*c*, in the mounting position, to obtain a Z-shaped cross section.

Figure 7:
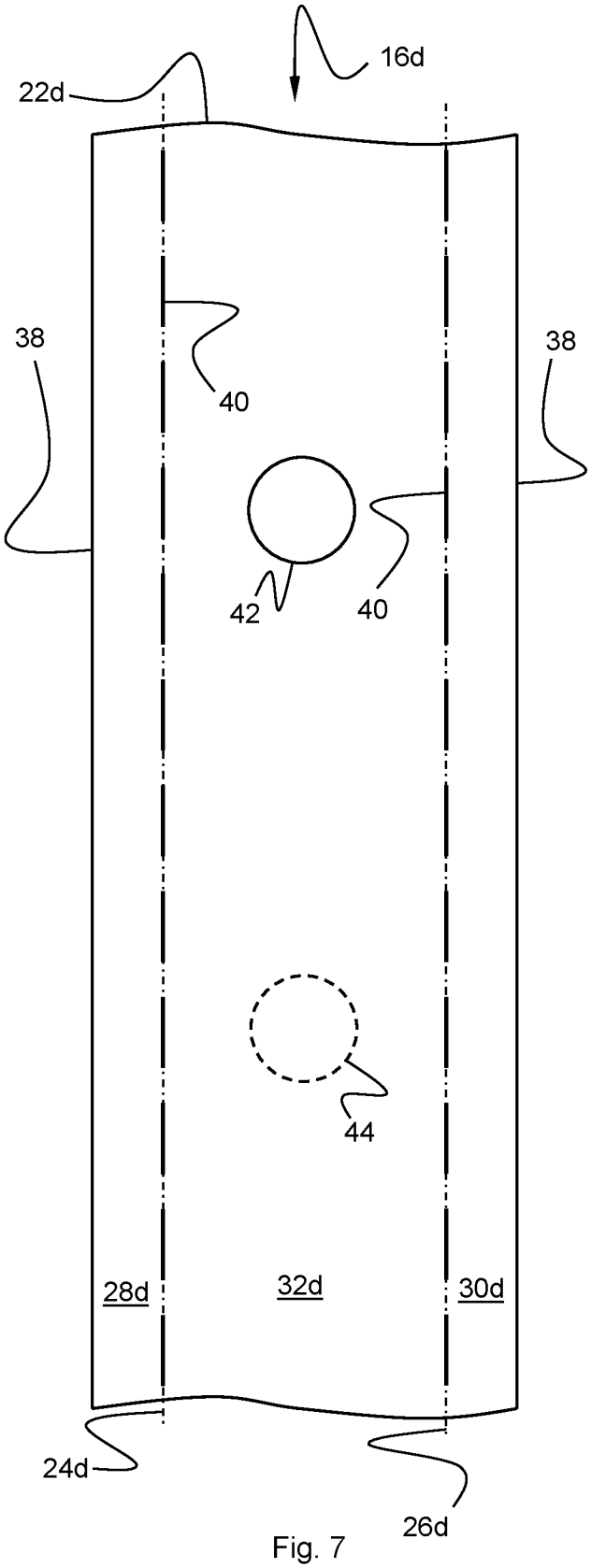
FIGS. 7 and 8 show various embodiments of sheet metal members which can be included in a building stud according to the invention.

FIG. 7 shows a web portion 16*d* which is intended to be part of a building stud according to the embodiment of the invention described above with reference to FIGS. 1 and 2. Web portion 16*d* comprises an elongated sheet metal member 22*d* having a rectangular shape and two parallel longitudinal edges 38. In the illustrated embodiment, the sheet metal member 22*d* has a width of about 120 mm. However, it will be appreciated that the width of the sheet metal member 22*d* can be adjusted to the desired thickness of the building stud in the mounting position (considering the thickness of the flange portions). The length of the sheet metal member 22*d* is adjusted to the desired length of the building stud in the storage position.

In the embodiment shown, the sheet metal member 22*d* has a thickness of about 0.5 mm. However, it will be appreciated that the thickness of the sheet metal member 22*d* can be adjusted to the desired strength of the building stud in the mounting position. Typically, the thickness of the sheet metal member 22*d* may be within the range of 0.3-1.5 mm.

The sheet metal member 22*d* has a first line of weakness 24*d* and a second line of weakness 26*d* which are rectilinear and parallel, and along which the sheet metal member 22*d* is foldable to allow bringing the building stud from the storage position to the mounting position, as described above. In the illustrated embodiment, the lines of weakness 24*d*, 26*d* comprise rectilinear recesses or incisions 40 extending along each line of weakness 24*d*, 26*d*. The incisions 40 are about 20 mm long and are spaced about 5 mm apart. For a sheet metal member having a thickness of 0.5 mm, it has been found that this configuration provides a good combination of mountability and strength of the building stud, i.e. a configuration which allows the installer to relatively easily bring the building stud from the storage position to the mounting position, but which configuration simultaneously provides the required strength of the building stud in the mounting position.

The sheet metal member 22*d* comprises a first attachment portion 28*d* intended to abut and attach to a first flange portion of the building stud, and a second attachment portion 30*d* intended to abut and attach to a second flange portion of the building stud as described above. Between them, the attachment portions 28*d*, 30*d* define web member 32*d*, which is intended to form a flange of the building stud in the mounting position. Thus, the first line of weakness 24*d* forms a boundary between the first attachment portion 28*d* and the web member 32*d*, and the second line of weakness 26*d* forms a boundary between the second attachment portion 30*d* and the web member 32*d*.

In the illustrated embodiment, the lines of weakness 24*d*, 26*d* are arranged approximately 20 mm from the respective longitudinal edge 38. However, it will be appreciated that the area of the attachment portions 28*d*, 30*d* can be adjusted by placing the lines of weakness 24*d*, 26*d* further away or closer to the longitudinal edges 38. For example, said area can be adapted to the type of joints used between the attachment portions 28*d*, 30*d* and the flange portions.

The sheet metal member 22*d* may comprise recesses 42 for pipe or cable penetrations. The sheet metal member 22*d* may alternatively, or as a complement, comprise attenuation lines 44 for forming pipe or cable penetrations.

Figure 8:
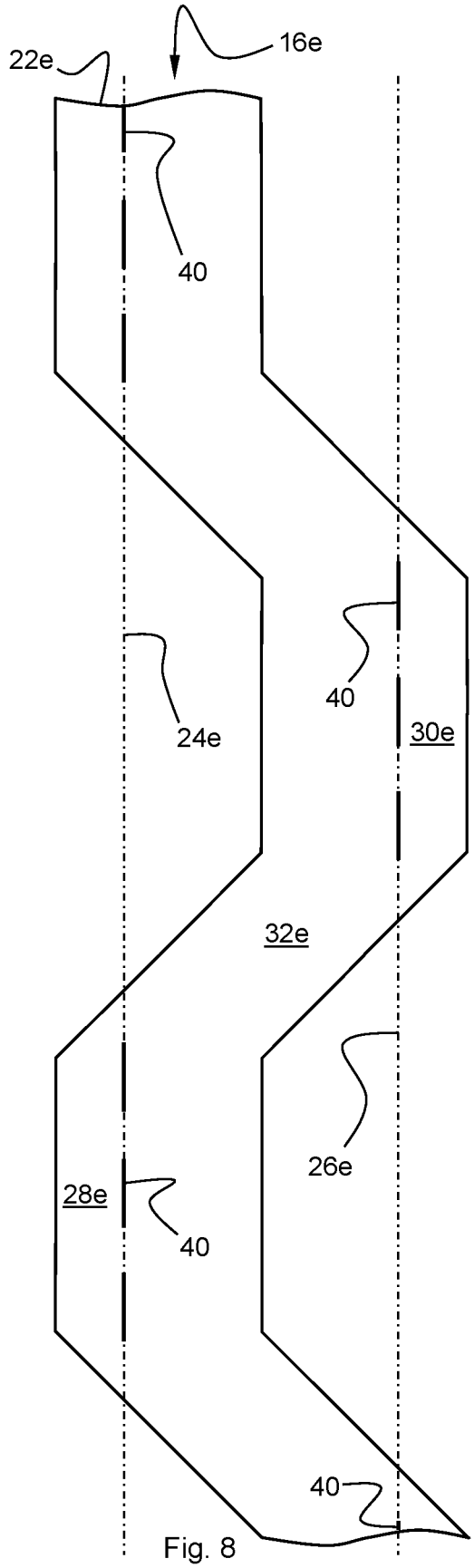

FIG. 8 shows a web portion 16*e* which is intended to be included in a building stud according to a further embodiment of the invention. In this embodiment, the web portion 16*e* comprises a sheet metal member 22*e* which has a zigzag shape but otherwise has lines of weakness 24*e*, 26*e* having the same function as the lines of weakness described above, i.e. they divide the sheet metal member 22*e* into attachment portions 28*e*, 30*e* and an intermediate web member 32*e*, which attachment portions 28*e*, 30*e* are intended to abut and attach to flange portions to form the building stud, and which lines of weakness 24*e*, 26*e* form lines along which the sheet metal member can be folded to bringing the building stud from a retracted storage position to an expanded mounting position, equivalent to what has been described above.

It will be appreciated that by changing the dimensions of the flange and web members and placing the lines of weakness in different positions, a variety of stud configurations can be obtained.

In the embodiments described above, the respective web portion comprises a sheet metal member extending along the stud. However, in alternative embodiments, the web portion may comprise a plurality of sheet metal members spaced apart along the stud, for example as shown in FIG. 9.

Figure 9:
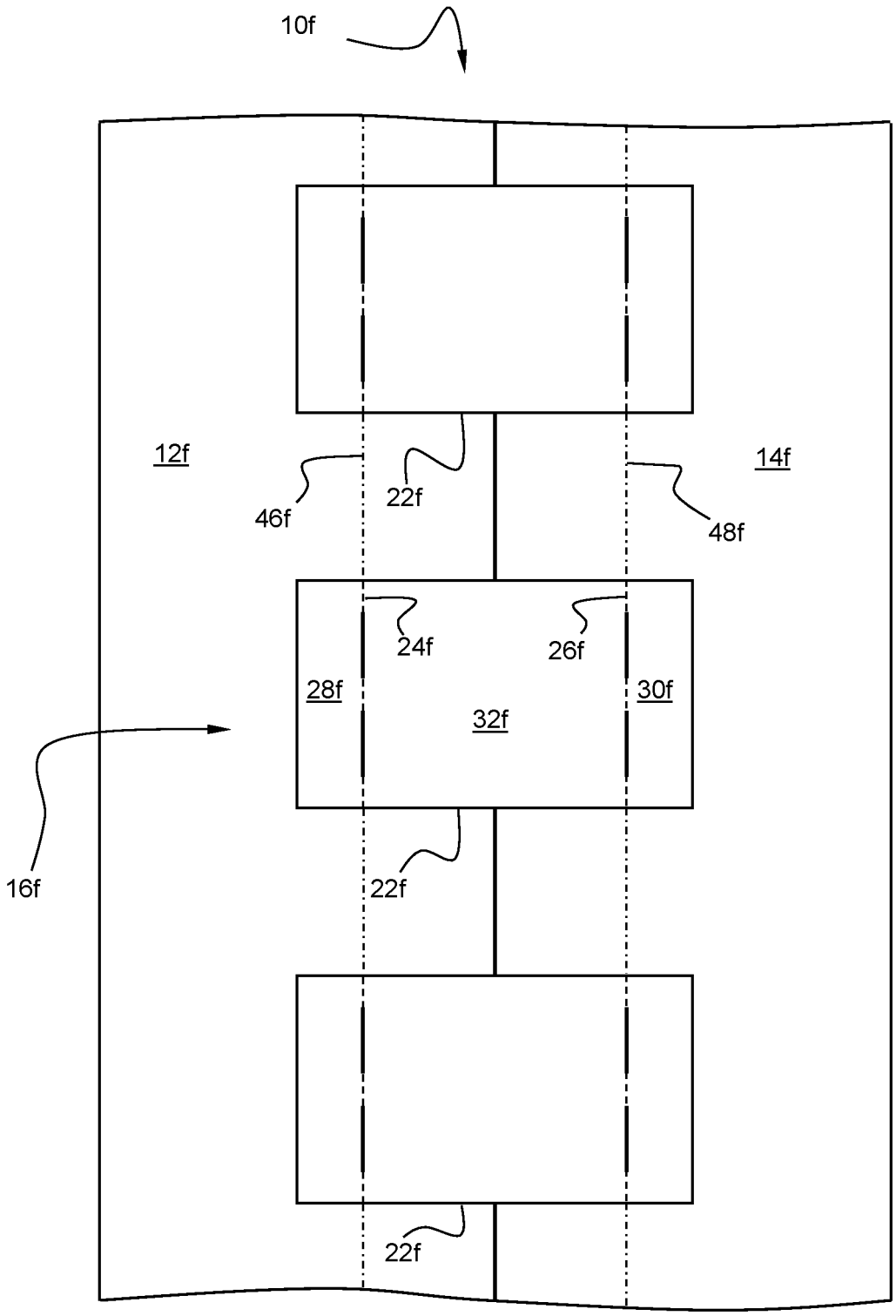
FIG. 9 shows an embodiment of a building stud according to the invention in a storage position.

FIG. 9 shows an embodiment of a building stud 10*f* according to the invention. The stud 10*f* comprises a first flange portion 12*f* and a second flange portion 14*f* and a web portion 16*f* connecting the flange portions 12*f*, 14*f*. The web portion 16*f* comprises a plurality of sheet metal members 22*f* having lines of weakness 24*f*, 26*f* having the same function as the lines of weakness described above, i.e. they divide the respective sheet metal member 22*f* into attachment portions 28*f*, 30*f* and an intermediate web member 32*f*, which attachment portions 28*f*, 30*f* are intended to abut and attach to flange portions to form the building stud, and which lines of weakness 24*f*, 26*f* form lines along which the sheet metal member can be folded to bring the building stud 10*f* from the retracted storage position shown in the figure to an expanded mounting position, equivalent to what has been described above. The sheet metal members 22*f* are thus arranged so that the lines of weakness 24*f* are aligned along a common first rectilinear line 46*f*. Similarly, the lines of weakness 26*f* are aligned along a common second rectilinear line 48*f* which is parallel to the first rectilinear line 46*f*.

Figure 10:
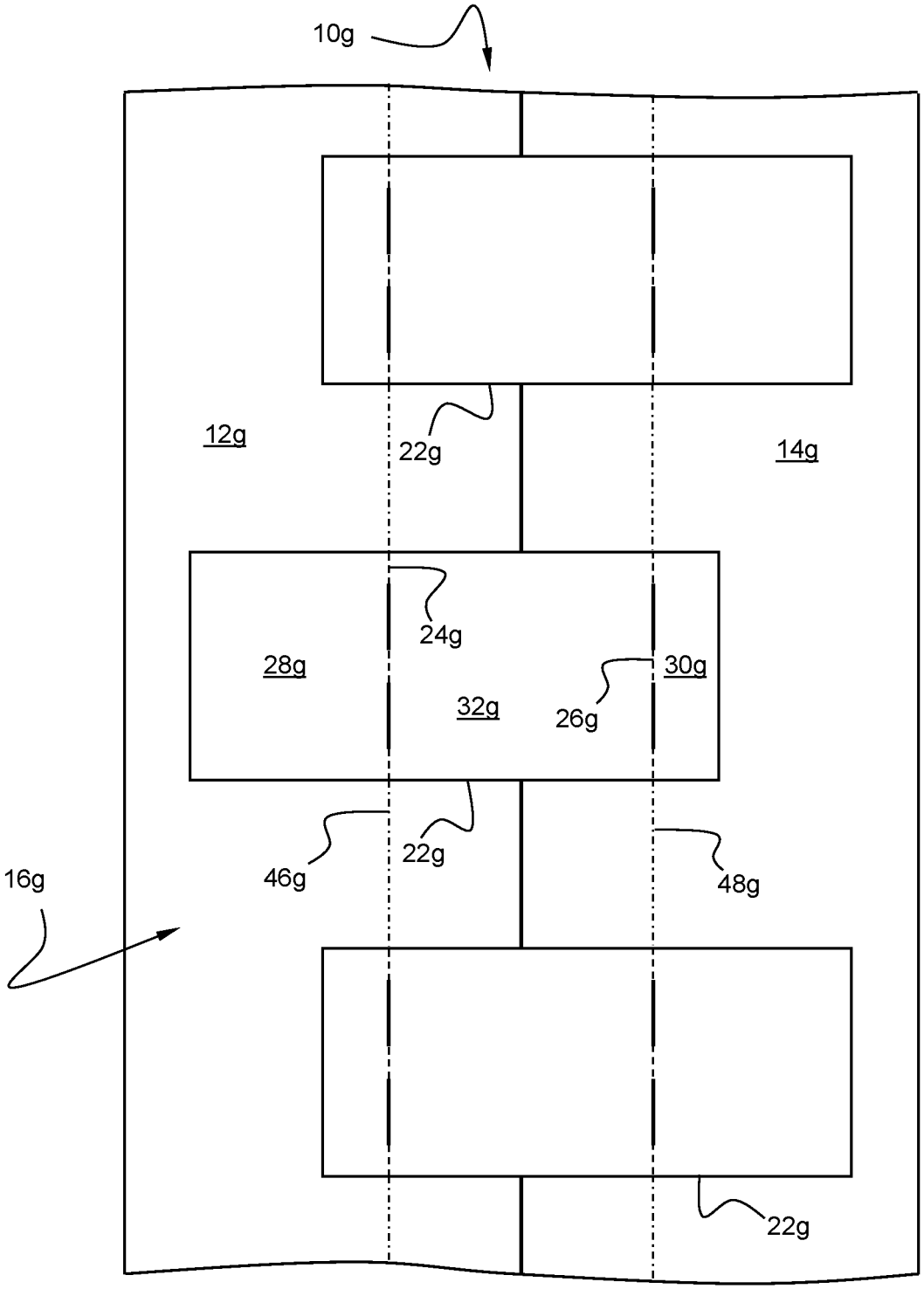
FIG. 10 shows a further embodiment of a building stud according to the invention in a storage position.

In the embodiment shown in FIG. 9, the sheet metal members 22*f* are uniform and symmetrically arranged in the building stud 10*f* in the storage position. However, it will be appreciated that the sheet metal members may be non-uniform and/or asymmetrically arranged as long as the lines of weakness of the sheet metal members are linearly aligned so as to form first and second lines of weakness in the web portion allowing the building stud to be brought from the retracted storage position to the expanded mounting position. An example of a building stud 10*g* comprising a web portion 16*g* with alternatively formed and arranged sheet metal members 22*g* is shown in FIG. 10, which sheet metal members 22*g* include lines of weakness 24*g*, 26*g* arranged along parallel rectilinear lines 46*g*, 48*g*.

The invention claimed is:

1. A building stud configured to form a framework for mounting wall panels, the building stud comprising a first and a second flange portion and a web portion interconnecting the first and the second flange portions, wherein each flange portion comprises a planar, elongated wood fiber member, and the web portion comprises a sheet metal member, wherein an entire length of the sheet metal member includes a first and a second rectilinear line of weakness, wherein the rectilinear lines of weakness are parallel and along which the sheet metal member is foldable to enable the building stud to be brought from a retracted storage position to an expanded mounting position.

2. The building stud according to claim 1, wherein the metal sheet member comprises a first attachment portion which abuts against and is attached to the first flange portion, a second attachment portion which abuts against and attached to the second flange portion, and a web member which is arranged between the attachment portions, which the first rectilinear line of weakness forms a boundary between the first attachment portion and the web member, and which the second rectilinear line of weakness forms a boundary between the second attachment portion and the web member.

3. The building stud according to claim 1, wherein the flange portions in the storage position, are arranged in a common plane, and that the flange portions, in the mounting position, are arranged in two parallel planes.

4. The building stud according to claim 3, wherein the web portion, in the storage position, is planar and arranged parallel to and on top of the flange portions.

5. The building stud according to claim 1, wherein the wood fiber members each have a rectangular cross-section.

6. The building stud according to claim 1, wherein the sheet metal member, in the storage position, has a rectangular shape, and in that the sheet metal member, in the mounting position, has a U shaped cross section.

7. The building stud according to claim 1, wherein the sheet metal member is elongated.

8. The building stud according to claim 1, wherein the web portion comprises a plurality of the sheet metal members which are arranged so that each first rectilinear line of weakness is aligned along a common first rectilinear line and each second rectilinear line of weakness is aligned along a common second rectilinear line, which the second rectilinear lines of weakness are parallel to the first rectilinear lines of weakness.

9. A wall structure wherein it comprises a building stud according to claim 1.

10. A method of providing a wall structure comprising a plurality of elongated building studs each comprising a first and a second flange portion and a web portion interconnecting the flange portions, wherein each flange portion comprises a planar elongated wood fiber member, and wherein the web portion comprises a sheet metal member including a first and a second rectilinear line of weakness that runs along an entire length of the sheet metal member, wherein the first and the second rectilinear lines of weakness are parallel, the method comprising the step of:

bringing each building stud, by folding the sheet metal member along said rectilinear lines of weakness from a retracted storage position in which the flange portions are arranged in a common plane to an expanded mounting position in which the flange portions are arranged in two parallel planes.

11. The method according to claim 10, comprising the steps of:

bringing the building studs from the storage position to the mounting position, positioning and fixing the building studs in a framework with their respective first flange portion arranged in a common plane; and attaching one or a plurality wall panels directly or indirectly to the first flange portions.

* * * * *